United States Patent [19]

Demuth et al.

[11] Patent Number: 4,974,295

[45] Date of Patent: Dec. 4, 1990

[54] MOTE KNIFE ARRANGEMENT FOR FITTING TO A FLAT OF A CARDING MACHINE

[75] Inventors: Robert Demuth, Nuerensdorf; Urs Staehli, Turbenthal, both of Switzerland

[73] Assignee: Rieter Machine Works Ltd., Winterthur, Switzerland

[21] Appl. No.: 331,308

[22] Filed: Mar. 31, 1989

[30] Foreign Application Priority Data

Apr. 7, 1988 [DE] Fed. Rep. of Germany ..... 3811681

[51] Int. Cl.[5] ..... D01G 15/12

[52] U.S. Cl. ..... 19/113; 19/104

[58] Field of Search ..... 19/81, 84, 96, 97, 97.5, 19/98, 99, 100, 101, 102, 103, 104, 105, 107, 110, 111, 113, 115 R, 200

[56] References Cited

U.S. PATENT DOCUMENTS

| | | | |
|---|---|---|---|
| 205,805 | 7/1878 | Moog | 19/98 |
| 3,205,537 | 9/1965 | Reiterer | 19/105 |
| 4,271,564 | 6/1981 | Estebanell | 19/107 |
| 4,400,852 | 8/1983 | Löffler | 19/107 |
| 4,438,549 | 3/1984 | Silander | 19/113 |
| 4,528,724 | 7/1985 | Bisquolm | 19/113 |
| 4,651,387 | 3/1987 | Giuliani | 19/113 |
| 4,654,933 | 4/1987 | Horn et al. | 19/107 |

FOREIGN PATENT DOCUMENTS

| | | |
|---|---|---|
| 3702688 | 10/1987 | Fed. Rep. of Germany . |
| 225599 | 7/1985 | German Democratic Rep. . |
| 662824 | 10/1987 | Switzerland . |

*Primary Examiner*—Werner H. Schroeder
*Assistant Examiner*—Michael A. Neas
*Attorney, Agent, or Firm*—Sandler, Greenblum & Bernstein

[57] ABSTRACT

A mote knife arrangement is fitted to a flat of a card or carding machine in a position so as to extend substantially transversely to the carding direction and the mote knife or blade is at an inclination so as to extend in a direction substantially opposite to the carding direction. A steel profile defining the mote knife or blade is provided for the mote knife arrangement. The steel profile is positively and non-slidably retained at a support or carrier which is mountable at the associated flat. The steel profile provided for the mote knife arrangement is retained at the support or carrier by permanent plastic deformation of such support or carrier which has a predetermined profile or sectional shape. The longitudinal direction of the profiled support or carrier also extends substantially transversely to the carding direction.

29 Claims, 2 Drawing Sheets

Fig. 2

MOTE KNIFE ARRANGEMENT FOR FITTING TO A FLAT OF A CARDING MACHINE

BACKGROUND OF THE INVENTION

The present invention broadly relates to mote waste removal in carding machines or cards and, more specifically pertains to a new and improved mote knife arrangement for fitting to a flat of a carding machine or card.

Generally speaking, the mote knife arrangement of the present invention is of the type which is fitted or mounted to a flat of a card or carding machine in a position so as to extend substantially transversely with respect to a predetermined carding direction and wherein the mote knife or blade is disposed at an inclination so as to extend in a direction substantially opposite to the carding direction.

A known mote knife or blade comprises a solid relatively thick piece of steel, on one lengthwise side of which a knife edge is incorporated. On the opposite lengthwise side the mote knife or blade is structured to be very solid or massive and forms a fixing flange which is secured to the associated flat by bolted or screw connections.

Flats of this kind equipped with mote knives can be fitted, mainly as stationary flats, to various locations of a card or carding machine. For example, they may be situated immediately after the feed roll or roller beneath the licker-in and opposite the same, or in the pre-carding zone between the licker-in or taker-in and the revolving flat or flat top opposite the card or carding cylinder. It is also possible to dispose stationary flats of this kind between the revolving flat or flat top and the doffer roller located opposite the carding cylinder. In every position the known solid or massive mote knife requires a relatively large peripheral space where it extends around the associated body of rotation i.e. around the licker-in or carding cylinder. It would be preferable to have this space available for other purposes or, if there is a larger amount of space available, to make the diameter of the licker-in or of the carding cylinder smaller.

The manufacture of the solid or massive mote knife requires a corresponding constructional expenditure and is therefore generally uneconomical.

SUMMARY OF THE INVENTION

Therefore, with the foregoing in mind, it is a primary object of the present invention to provide a new and improved construction of a mote knife arrangement which does not exhibit the aforementioned drawbacks and shortcomings of the prior art.

Another and more specific object of this invention aims at providing a new and improved mote knife arrangement of the previously mentioned type which by virtue of a simple and compact construction and design is quite economical to manufacture, occupies relatively little space, is easy to fit and replace, but provides at least comparable functional and operational results to those achieved by the known solid mote knife.

Yet a further significant object of the present invention aims at providing a new and improved construction of a mote knife arrangement of the character described which is extremely simple and lightweight in construction and design, highly reliable in operation, not readily subject to malfunction and breakdown and requires only a minimum of maintenance and servicing.

Now to implement these and still further objects of the invention, which will become more readily apparent as the description proceeds, the mote knife arrangement of the present invention is manifested, among other things, by the features that a steel profile defining the mote knife or blade is provided for the mote knife arrangement and this steel profile is positively and non-slidably retained or held at a support or carrier or support member which is mountable at the associated flat. The steel profile provided for the mote knife arrangement is retained or held at the related support or carrier by permanent plastic deformation of such support or carrier which has a predetermined profile or sectional shape. The longitudinal direction of the profiled support or carrier also extends substantially transversely to the carding direction.

If required, the mote knife or blade or knife or blade element is not finally ground until after the steel profile has been inserted or positively received at the support or carrier. The support or carrier forms a suitable holder or mounting for the steel profile which, according to the invention, is comparatively unmachined and which is used both during grinding of the knife edge and during final fitting of the mote knife arrangement to the associated flat.

The use of a steel profile of this kind and defining the mote knife or blade renders possible the production thereof as a mass produced product or a product or article which can be fabricated so-to-speak by the meter at a favorable cost. The support or carrier constructed in the form of a profile or sectional member is also economical to manufacture. The plastic deformation of the support or carrier profile around the steel profile defining the mote knife or blade in order to positively and non-slidably retain or hold the latter in the operative position can be accomplished with relatively simple means, for example, by means of a pressure roll or roller which moves along the profiled support or carrier and deforms the latter. The deformation is preferably carried out in the cold state, because there can be thus achieved a very resistant positive or form-locking retention of the steel profile in the profiled support or carrier due to cold-flow of the metal support or carrier. In other words the material of the support or carrier is, as it were, forged around the steel profile defining the mote knife or blade.

The profiled support or carrier may and should be somewhat flexurally elastic so that the mote knife or blade does not assume its final position until the support or carrier is fitted to the relatively stiff and very accurately machined flat. The accuracy of the shape or form of the flat thus ensures the accuracy of the position of the knife edge of the mote knife or blade, this being particularly important in view of the very close tolerances and spacings which are usual with cards or carding machines.

Furthermore, by virtue of the flexibility of the support or carrier containing the steel mote knife or blade there is no appreciable transmission of forces to the bar or the like forming the associated flat, so that there is no deformation of the latter and thus no deterioration of the accuracy of the bar due to the mounting of the working element or mote knife arrangement.

Preferably, the support or carrier constructed in the form of a profile or sectional member also serves as a support for known scraper means or card clothing, for example, in the form of a saw-tooth clothing or spiked clothing. In this manner, very little space is required to accommodate the steel profile which itself is relatively small. Examples of suitable saw-tooth or spiked clothing which can be used with the mote knife or blade or its support or carrier of the mote knife arrangement constructed according to the invention are disclosed in Swiss Patent No. 662,824, published Oct. 30, 1987 and East German Patent No. 225,599, published July 31, 1985.

Preferably, the support or carrier constructed in the form of a profile or sectional member comprises an aluminum alloy. In this manner, an overall lightweight construction is achieved and the support or carrier can be constructed to be formed as an extrusion and yet have the properties and characteristics required for forging the extrusion around the steel profile defining the mote knife or blade.

Preferably, the steel profile has in cross-section the shape of a rectangle from which one edge or corner region has been removed to form a pointed or sharp knife edge and an inclined surface at the steel profile. A steel profile of this kind can be very economically manufactured with good knife or blade properties or characteristics by means of rolls or rollers, without any costly machining operation being required apart from sharpening the actual knife or blade edge.

Preferably, the inclined surface so intersects that lengthwise side of the rectangle which is located opposite the knife edge, along a line extending in the longitudinal direction of the steel profile, that the remainder of the lengthwise side of the rectangular cross-section has a length of less than one-half the length of the full lengthwise side. The inclined surface merges, either directly or by way of a transition step, into that lengthwise side of the rectangle which is located opposite the knife edge. In this manner, the magnitude of the acute angle of the knife edge of the steel profile can be varied within wide limits, without the steel profile becoming so thin as to no longer possess adequate or sufficient stability or be anchored only inadequately in the associated support or carrier.

Preferably, the support or carrier which is constructed in the form of a profile or sectional member, has in contour overall an approximately rectangular shape or form such that the lengthwise side of the profiled support or carrier and which is remote from the flat is either at least substantially flat or constructed to receive a card clothing.

The upstream located short side of the profiled support or carrier viewed in the carding direction and constructed to receive the steel profile defining the mote knife or blade comprises a groove or recess of substantially U-shaped cross-section aligned with the back or back-off angle of the mote knife or blade. The mote knife or blade, i.e. the steel profile, is accommodated in this substantially U-shaped groove or recess, its knife edge projecting beyond the contour or outer surface of the profiled support or carrier. According to the invention, that limb or leg of the profiled support or carrier which is formed by the substantially U-shaped groove or recess and which is adjacent the front surface or side of the mote knife or blade is plastically deformed such that it bears partially against the inclined surface of the steel profile or against the transition step of the steel profile in order to thus provide positive or form-locking and non-slidable reception for the steel profile defining the mote knife or blade.

In a particularly preferred embodiment of the mote knife arrangement constructed according to the invention, that side of the limb or leg which is remote from the front surface or side of the mote knife or blade is formed by an at least substantially V-shaped groove in the associated support or carrier. In this manner, while allowing for the angle of inclination of the mote knife or blade, the aforementioned limb or leg can be constructed to possess a substantially constant thickness and it can thus be adequately deformed around that back part of the steel profile which is remote from the knife edge.

As viewed in the carding direction, a closed chamber in the profiled support or carrier can be preferably formed downstream of the region or zone containing the substantially U-shaped groove or recess, this closed chamber being in cross-section preferably similar to a reversed "B".

Alternatively, there can be provided a substantially V-shaped groove or recess which, as viewed in the carding direction, is disposed downstream of that region or zone of the support or carrier which contains the substantially U-shaped groove or recess. One side of the substantially V-shaped groove or recess is at least substantially parallel to the base or bottom of the substantially U-shaped groove or recess accommodating the steel profile defining the mote knife or blade.

Preferably, the support or carrier constructed in the form of a profile or structural member comprises a substantially T-shaped recess or chamber in the middle or intermediate region thereof. The cross portion of the T-shaped recess or chamber extends substantially parallel to the lengthwise sides of the rectangular support or carrier and the normal or perpendicular limb or leg of the T-shaped recess or chamber opens at that side of the support or carrier which faces or confronts the flat.

The substantially T-shaped recess or chamber is separated by a web from the substantially V-shaped groove or recess located downstream of the steel profile defining the mote knife or blade. In one particularly preferred configuration of the profiled support or carrier, a substantially L-shaped chamber is provided on that side of the substantially T-shaped recess or chamber which is remote from the mote knife or blade. The perpendicular limb or leg of the substantially L-shaped chamber opens at that side of the support or carrier which faces or confronts the flat and is separated by a web from the substantially T-shaped recess or chamber.

As a result of these special configurations or constructions of the support or carrier, those wall parts and webs of the profile or structural member which form the support or carrier have at least substantially the same thickness throughout. This construction beneficially simplifies the manufacture of the profiled support or carrier possessing uniform characteristics and this, in turn, ensures positive accommodation of the steel profile or of any card clothing provided.

Furthermore, it is unnecessary for the substantially U-shaped groove, which is preferably provided to receive or accommodate the steel profile defining the mote knife or blade, to be mechanically machined prior to insertion of the steel profile, since the same can be manufactured with favorable tolerances owing to the manner in which these substantially U-shaped grooves are designed or formed according to the invention. By deforming the extruded profiled support or carrier around the steel profile, an adequately firm seat thereof is ensured even in the event of slight or minor tolerances of the substantially U-shaped groove. Manufacture of the mote knife arrangement is thus further simplified and therefore extremely economical.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the different embodiments of mote knife arrangements has been illustrated therein as is needed to enable one skilled in the art to readily understand the underlying principles and concepts of the present invention. Turning attention now specifically to FIG. 1 of the drawings, a mote knife arrangement illustrated therein by way of example and not limitation will be seen to comprise a support or carrier 10 manufactured as a profile or sectional member by extrusion of an aluminum alloy. The profile of this support or carrier 10 constitutes an approximately rectangular configuration.

Figure 1:
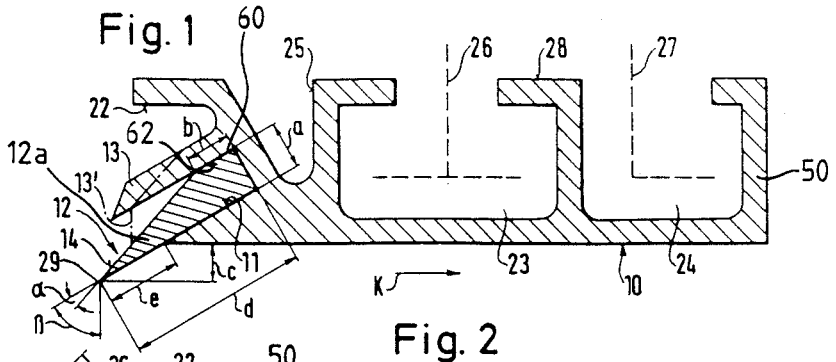
FIG. 1 is a cross-section through a first embodiment of the mote knife arrangement constructed according to the invention.

The profiled support or carrier 10 comprises a substantially U-shaped groove or recess 11 into which a steel profile 12, which forms the actual mote knife or blade 12*a*, is inserted. After insertion of the steel profile 12 a limb or leg 13 of the profiled support or carrier 10 is bent downwards, as depicted in FIG. 1, and thereby undergoes plastic deformation, so that the limb or leg 13 assumes the position 13' in which it bears against an inclined surface 14 of the steel profile 12 of the mote knife or blade 12*a* and, together with the other boundary walls of the substantially U-shaped groove or recess 11, forms a positive or form-locking holder or carrier for the steel profile 12. It will be seen that the steel profile 12 possesses in cross-section the shape of a rectangle from which one edge or corner region has been removed to form the mote knife of the steel profile 12 containing a knife edge or tip 29 and defining the inclined surface 14.

The rectangle of the steel profile 12 has a lengthwise side 60 located remote from the knife edge or tip 29 and the inclined surface 14 of the steel profile 12 intersects this lengthwise side 60 following removal of the one edge or corner region along a line which extends in the longitudinal direction of the steel profile 12.

The remainder length 62 of this lengthwise side 60 located remote from the knife edge or tip 29 and following removal of the one edge or corner is less than half the full length of the lengthwise side 60, preferably in the range of 0.2 to 0.4 times the full length of the lengthwise side 60, and advantageously 0.3 times the full length of the lengthwise side 60.

The ratio of the lengths of the short and long sides of the rectangular cross-section of the steel profile 12 is in a range between 1:3 and 1:7, and amounts advantageously to approximately 1:5.

The profiled support or carrier 10 comprises a number of grooves or recesses or chambers to save weight, facilitate extrusion, and allow mounting at the associated stationary flat of a card or carding machine.

Figure 5:
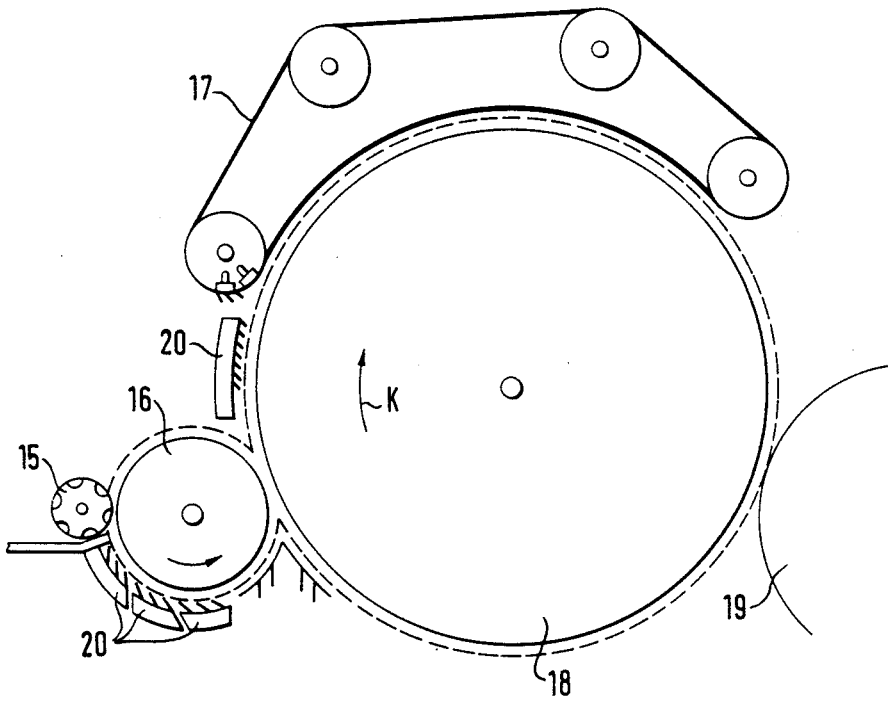
FIG. 5 is a schematic illustration of a card having stationary flats at which mote knife arrangements constructed according to the invention can be mounted.

Referring to FIG. 5, by means of the associated support or carrier 10, the mote knife or blade 12*a* can be arranged either downstream of a feed roll or roller 15 and below a licker-in 16 or between the licker-in 16 and a revolving flat 17 located opposite a carding cylinder 18. It would also be possible to dispose the mote knife arrangement in a post-carding region or zone between the revolving flat 17 and a doffer roll or roller 19.

The support or carrier 10 may be secured at an associated flat or associated flats 20 in known manner. For such purpose and advantageously a substantially V-shaped groove or recess 22 is located above the steel profile 12, a substantially T-shaped chamber or recess 23 is arranged downstream of the steel profile 12 as viewed in the carding direction K, and a substantially L-shaped chamber or recess 24 is arranged downstream of the substantially T-shaped chamber or recess 23. The substantially V-shaped groove or recess 22 is used not only to mount the support or carrier 10, but also determines the form or shape of the limb or leg 13 and thus also provides access to such limb or leg 13, so that the deformation of this limb or leg 13 over the inclined surface 14 of the steel profile 12 of the mote knife or blade 12*a* can be easily accomplished. Downstream of the substantially V-shaped groove 22 there is located a further substantially V-shaped groove or recess 25 which opens on a side 28 of the support or carrier 10, which side 28 faces or confronts the associated flat which is not particularly shown in FIG. 1.

Similarly, a perpendicular limb or leg 26 of the inverted substantially T-shaped chamber or recess 23 and a perpendicular limb or leg 27 of the substantially L-shaped chamber or recess 24 open on that side 28 of the support or carrier 10 which faces the flat. As depicted in FIG. 1, the thickness of the individual webs and wall parts, generally indicated by reference numeral 50, of the support or carrier 10 is at least substantially constant with few exceptions, and this beneficially simplifies manufacturing the profiled support or carrier 10 by extrusion.

In one practical example, the length of the support or carrier 10, i.e. in a direction perpendicular to the plane of the drawing, is 1014 mm. The steel profile 12 is of the same length. The width of the support or carrier 10 in the direction, in the drawing, from the left end to the right end thereof is 34 mm, and the thickness thereof, i.e. the height from the top to the bottom of the support or carrier 10, shown in FIG. 1, is 9 mm. The wall thickness of the webs and wall parts 50 is 1.25 mm.

The cross-sectional shape of the steel profile 12 possesses a length in the range of 7 mm to 15 mm and a width in the range of 1.5 to 3.5 mm measured at a cross-sectional end of the rectangle located remote from the knife edge or tip 29.

The front side and the rear side of the mote knife or blade 12*a* define at the knife edge or tip 29 an apex angle $\alpha$ in a range between 8° and 20°.

The main dimensions of the steel profile 12 are designated in FIG. 1 with the reference characters a, b, c, d and e and are preferably 2.5 mm, 2.5 mm, 2.0 mm, 10 mm and 4.0 mm, respectively. The acute apex angle $\alpha$ between the front side and the rear side of the knife edge or tip 29 is about 18° and the back or back-off angle $\beta$ of the steel profile 12 in the inserted position is about 60°.

Figure 2:
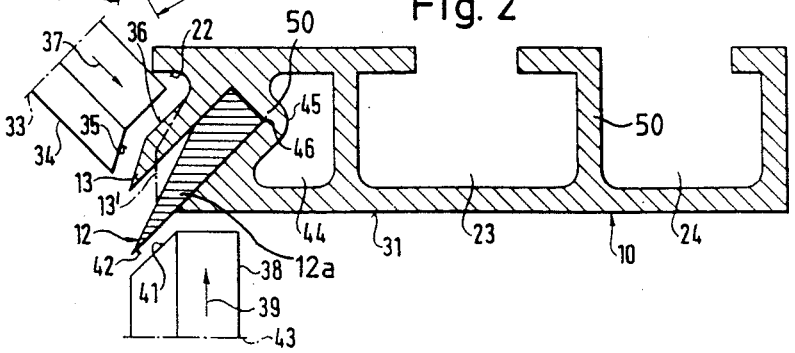
FIG. 2 is a cross-section through a second embodiment of the mote knife arrangement constructed according to the invention, the manufacturing process being schematically indicated.

FIG. 2 shows a somewhat modified embodiment, only those parts which deviate from the showing in FIG. 1 being described in detail. The steel profile 12 defining the mote knife or blade 12*a* and shown in FIG. 2 is the same as that depicted in FIG. 1, but has been inserted into the associated support or carrier 10 at a steeper back or back-off angle of about 45°, so that the corresponding substantially U-shaped groove or recess 11 also forms a steeper angle with a side 31 of the support or carrier 10, and which side 31 faces or confronts the card or carding machine. In this exemplary embodiment, the dimension c is also 2 mm. The depth of the substantially V-shaped groove or recess 22 is somewhat less than in the exemplary embodiment depicted in FIG. 1, but on the other hand, the limb or leg 13 is somewhat longer. This affords better access for a roll or roller 34 which is rotatable about an axis 33. A surface 35 of this roll or roller 34 is adapted to the shape of an outer surface 36 of the limb or leg 13. To deform the limb or leg 13 into the position 13', the roll or roller 34 rotating about the axis 33 is pressed against the surface 36 of the limb or leg 13 in the direction of the arrow 37. At the same time, a roll or roller 38 arranged beneath the support or carrier 10 is pressed against the underside of this support or carrier 10 or of the steel profile 12 in the direction of the arrow 39. The surface 41 of the roll or roller 38 is constructed to be complementary to the contacting side or surface 31 of the support or carrier 10 and a contacting surface 42 of the steel profile 12.

Since the rolls or rollers 34 and 38 are pressed with considerable force in the directions of the arrows 37 and 39, respectively, there is a cold flow of the material of the support or carrier 10 around the steel profile 12 defining the mote knife or blade 12*a*, so that the latter is positively and non-slidably retained or held. During the application of these forces the rolls or rollers 34 and 38 rotate relatively slowly about the associated axes of rotation 33 and 43, respectively, and the support or carrier 10 is moved in a direction substantially perpendicular to the plane of FIG. 2 at a speed corresponding substantially to the surface speed of the rolls or rollers 34 and 38.

As can be derived from FIG. 2, there is no V-shaped groove or recess 25 in the embodiment depicted in FIG. 2. On the other hand, a chamber 44 is provided in the support or carrier 10 between the steel profile 12 and the substantially T-shaped chamber or recess 23. The chamber 44 in cross-section has a reversed substantially B-shape. A thus resulting nose or protuberance 45 forms a wall of substantially constant thickness around an edge 46 of the steel profile 12.

Figure 3:
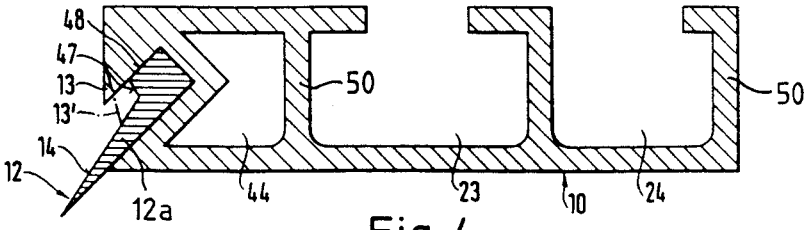
FIG. 3 is a cross-section through a third embodiment of the mote knife arrangement constructed according to the invention.

The exemplary embodiment shown in FIG. 3 is slightly modified with respect to the exemplary embodiment shown in FIG. 2. Here again, only the different features are described in detail. The steel profile 12 defining the mote knife or blade 12*a* is of somewhat different shape such that the acute apex angle $\alpha$ is about 10° and thus smaller than in the case of the steel profile 12 shown in FIGS. 1 and 2. As a result, the inclined surface 14 merges into a top part or portion 48 of the steel profile 12 by way of a transition step 47. The back or back-off angle $\beta$, however, is about 45° as in the embodiment shown in FIG. 2. In other respects, the dimensions of the steel profile 12 also correspond to the dimensions of the steel profile 12 shown in FIG. 2.

There is no V-shaped chamber or recess 22 in the exemplary embodiment of FIG. 3, but it may also be provided. Furthermore, the closed chamber 44 has a somewhat more angular or cornered shape.

Figure 4:
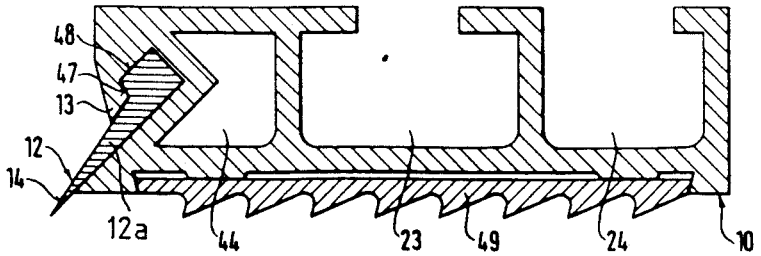
FIG. 4 is a cross-section through a fourth embodiment of the mote knife arrangement constructed according to the invention.

Finally, FIG. 4 shows a particularly preferred exemplary embodiment of the mote knife arrangement, in which the steel profile 12 defining the mote knife or blade 12*a* is fitted together with a substantially saw-tooth clothing 49 in one and the same support or carrier 10. The steel profile 12 is entirely identical with the steel profile 12 depicted in FIG. 3 and the support or carrier 10 is modified only slightly with respect to the support or carrier 10 depicted in such FIG. 3 in order to accommodate strip-shaped saw-tooth inserts 49, only one of which is visible in FIG. 4. The advantage of this construction is that it is particularly space-saving and in addition provides excellent support for the knife edge of the steel profile 12 defining the mote knife or blade 12*a*.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A mote knife arrangement for fitting to a flat of a carding machine in a position so as to extend substantially transversely to a predetermined carding direction and comprising a mote knife disposed at an inclination so as to extend in a direction substantially opposite to the predetermined carding direction, comprising:

a steel profile defining the mote knife and a knife edge of said mote knife;

a support having a predetermined profile and a longitudinal direction;

said support containing members defining a groove extending in said longitudinal direction of said support for receiving said steel profile on a side remote from said knife edge;

said support consisting essentially of a material more readily plastically deformable than said steel profile;

said members defining said groove of said support being permanently plastically deformed and being forged into form-locking surface engagement with said steel profile on said side remote from said knife edge in order to thereby positively and undisplaceably retain said steel profile at said support;

said support being structured to be mountable at the flat of the carding machine; and said longitudinal direction of said support extending substantially transversely to the predetermined carding direction.

2. The mote knife arrangement as defined in claim 1, wherein:

said knife edge being finally ground only subsequent to the positive and undisplaceable retention of said steel profile at said support.

3. The mote knife arrangement as defined in claim 1, wherein:

said support having said predetermined profile is constructed to simultaneously serve as a carrier for card clothing.

4. The mote knife arrangement as defined in claim 3, wherein:

said card clothing comprises saw-tooth clothing.

5. The mote knife arrangement as defined in claim 3, wherein:

said card clothing comprises spiked clothing.

6. The mote knife arrangement as defined in claim 1, wherein:

said support having said predetermined profile comprises an aluminum alloy.

7. The mote knife arrangement as defined in claim 2, wherein:

said steel profile has in cross-section the shape of substantially a rectangle;

said rectangle including sides; and a corner region of predetermined sides of said rectangle being removed to form said mote knife of said steel profile containing said knife edge and defining an inclined surface at said steel profile.

8. The mote knife arrangement as defined in claim 7, wherein:

said steel profile has a longitudinal direction;

said rectangle has as one of said predetermined sides a lengthwise side which is located remote from said knife edge;

said inclined surface at said steel profile intersecting said lengthwise side of said rectangle, following removal of said corner region along a line which extends in said longitudinal direction of said steel profile;

said lengthwise side of said rectangle having a predetermined length prior to removal of said corner region and a remainder length following removal of said corner region; and said remainder length of said lengthwise side being less than half said predetermined length of said lengthwise side.

9. A mote knife arrangement for fitting to a flat of a carding machine in a position so as to extend substantially transversely to a predetermined carding direction and comprising a mote knife disposed at an inclination so as to extend in a direction substantially opposite to the predetermined carding direction, comprising:

a steel profile defining the mote knife and a knife edge of said mote knife;

a support having a predetermined profile and a longitudinal direction;

said support containing members defining a groove extending in said longitudinal direction of said support for receiving said steel profile on a side remote from said knife edge;

said support consisting essentially of a material more readily plastically deformable than said steel profile;

said members defining said groove of said support being permanently plastically deformed and being forged into form-locking surface engagement with said steel profile on said side remote from said knife edge in order to thereby positively and undisplaceably retain said steel profile at said support;

said support being structured to be mountable at the flat of the carding machine;

said longitudinal direction of said support extending substantially transversely to the predetermined carding direction;

said knife edge being finally ground only subsequent to the positive and undisplaceable retention of said steel profile at said support;

said steel profile having in cross-section the shape of substantially a rectangle;

said rectangle including sides;

a corner region of predetermined sides of said rectangle being removed to form said mote knife of said steel profile containing said knife edge and defining an inclined surface at said steel profile;

said steel profile having a longitudinal direction;

said rectangle has as one of said predetermined sides a lengthwise side which is located remote from said knife edge;

said inclined surface at said steel profile intersecting said lengthwise side of said rectangle, following removal of said corner region along a line which extends in said longitudinal direction of said steel profile;

said lengthwise side of said rectangle having a predetermined length prior to removal of said corner region and a remainder length following removal of said corner region;

said remainder length of said lengthwise side being less than half said predetermined length of said lengthwise side;

a step provided between said inclined surface and said remainder length of said lengthwise side; and said inclined surface merging by way of said step into said remainder length of said lengthwise side.

10. The mote knife arrangement as defined in claim 8, wherein:

said remainder length of said lengthwise side has a length in the range of 0.2 to 0.4 times said predetermined length of said lengthwise side.

11. The mote knife arrangement as defined in claim 8, wherein:

said remainder length of said lengthwise side has a length of approximately 0.3 times said predetermined length of said lengthwise side.

12. The mote knife arrangement as defined in claim 8, wherein:

said sides of said rectangle comprising short and long sides; and the ratio of the lengths of the short and long sides of said rectangle being in a range between 1:3 and 1:7.

13. The mote knife arrangement as defined in claim 8, wherein:

said sides of said rectangle comprising short and long sides; and the ratio of the lengths of the short and longs sides of said rectangle amounting to approximately 1:5.

14. The mote knife arrangement as defined in claim 8, wherein:

said cross-sectional shape of said steel profile possesses a length in the range of 7 mm to 15 mm and a width in the range of 1.5 mm to 3.5 mm measured at a cross-sectional end of the rectangle located remote from said knife edge.

15. The mote knife arrangement as defined in claim 8, wherein:

said cross-sectional shape of said steel profile possesses a length of approximately 10 mm and a width of approximately 2.5 mm measured at a cross-sectional end of the rectangle located remote from said knife edge.

16. The mote knife arrangement as defined in claim 7, wherein:

said mote knife possesses a front side and a rear side; and said front side and said rear side of said mote knife define at said knife edge an apex angle in the range between 8° and 20°.

17. The mote knife arrangement as defined in claim 16, wherein:

said predetermined profile of said support constitutes an approximately rectangular configuration;

said approximately rectangular configuration having a lengthwise side which is located remote from the flat of the carding machine;

said lengthwise side of said approximately rectangular configuration being structured to be at least substantially flat;

said approximately rectangular configuration having an upstream located short side with respect to the predetermined carding direction;

said mote knife having a back-off angle; and said upstream located short side containing said members defining said groove for receiving said steel profile and which groove has a substantially U-shaped cross-section which is aligned with respect to said back-off angle of said mote knife defined by said steel profile.

18. The mote knife arrangement as defined in claim 3, wherein:

said predetermined profile of said support constitutes an approximately rectangular configuration;

said approximately rectangular configuration having a lengthwise side which is located remote from the flat of the carding machine;

said lengthwise side of said approximately rectangular configuration being structured to receive said card clothing;

said approximately rectangular configuration having an upstream located short side with respect to the predetermined carding direction;

said mote knife having a back-off angle; and said upstream located short side containing said members defining said groove for receiving said steel profile and which groove is aligned with respect to said back-off angle of said mote knife defined by said steel profile.

19. A mote knife arrangement for fitting to a flat of a carding machine in a position so as to extend substantially transversely to a predetermined carding direction and comprising a mote knife disposed at an inclination so as to extend in a direction substantially opposite to the predetermined carding direction, comprising:

a steel profile defining the mote knife and a knife edge of said mote knife;

a support having a predetermined profile and a longitudinal direction;

said support containing members defining a groove extending in said longitudinal direction of said support for receiving said steel profile on a side remote from said knife edge;

said support consisting essentially of a material more readily plastically deformable than said steel profile;

said members defining said groove of said support being permanently plastically deformed and being forged into form-locking surface engagement with said steel profile on said side remote from said knife edge in order to thereby positively and undisplaceably retain said steel profile at said support;

said support being structured to be mountable at the flat of the carding machine;

said longitudinal direction of said support extending substantially transversely to the carding direction;

said knife edge being finally ground only subsequent to the positive and undisplaceable retention of said steel profile at said support;

said steel profile having in cross-section the shape of substantially a rectangle;

said rectangle including sides;

a corner region of predetermined sides of said rectangle being removed to form said mote knife of said steel profile containing said knife edge and defining an inclined surface at said steel profile;

said mote knife possessing a front side and a rear side;

said front side and said rear side of said mote knife define at said knife edge an apex angle in the range between 9° and 20°;

said predetermined profile of said support constituting an approximately rectangular configuration;

said approximately rectangular configuration having a lengthwise side which is located remote from the flat of the carding machine;

said lengthwise said of said approximately rectangular configuration being structured to be at least substantially flat;

said approximately rectangular configuration having an upstream located short side with respect to the carding direction;

said mote knife having a back-off angle;

said upstream located short side comprising said groove which has a substantially U-shaped cross-section and is aligned with respect to said back-off angle of said mote knife formed by said steel profile;

said support having said predetermined profile comprising as one of said members a limb which is formed by said substantially U-shaped groove and is adjacent said front side of said mote knife; and said limb being plastically deformed such that it bears against said inclined surface of said steel profile in order to thus provide positive and undisplaceable reception of said steel profile.

20. A mote knife arrangement for fitting to a flat of a carding machine in a position so as to extend substantially transversely to a predetermined carding direction and comprising a mote knife disposed at an inclination so as to extend in a direction substantially opposite to the predetermined carding direction, comprising:

a steel profile defining the mote knife and a knife edge of said mote knife;

a support having a predetermined profile and a longitudinal direction;

said support containing members defining a groove extending in said longitudinal direction of said support for receiving said steel profile on a side remote from said knife edge;

said support consisting essentially of a material more readily plastically deformable than and steel profile;

said members defining said groove of said support being permanently plastically deformed and being forged into form-locking surface engagement with said steel profile on said side remote from said knife edge in order to thereby positively and undisplaceably retain said steel profile at said support;

said support being structured to be mountable at the flat of the carding machine;

said longitudinal direction of said support extending substantially transversely to the predetermined carding direction;

said knife edge being finally ground only subsequent to the positive and undisplaceable retention of said steel profile at said support;

said steel profile having in cross-section the shape of substantially a rectangle;

said rectangle including sides;

a corner region of predetermined sides of said rectangle being removed to form said mote knife of said steel profile containing said knife edge and defining an inclined surface at said steel profile;

said mote knife possessing a front side and a rear side;

said front side and said rear side of said mote knife define at said knife edge an apex angle in the range between 9° and 20°;

said predetermined profile of said support constituting an approximately rectangular configuration;

said approximately rectangular configuration having a lengthwise side which is located remote from the flat of the carding machine;

said lengthwise side of said approximately rectangular configuration being structured to be at least substantially flat;

said approximately rectangular configuration having an upstream located short side with respect to the carding direction;

said mote knife having a back-off angle;

said upstream located short side comprising said groove which has a substantially U-shaped cross-section and is aligned with respect to said back-off angle of said mote knife formed by said steel profile;

said steel profile having a longitudinal direction;

said rectangle has as one of said predetermined sides a lengthwise side which is located remote from said knife edge;

said inclined surface at said steel profile intersecting said lengthwise side of said rectangle, following removal of said corner region along a line which extends in said longitudinal direction of said steel profile;

said lengthwise side of said rectangle having a predetermined length prior to removal of said corner region and a remainder length following removal of said corner region;

said remainder length of said lengthwise side being less than half said predetermined length of said lengthwise side;

said support having said predetermined profile comprising as one of said members a limb which is formed by said substantially U-shaped groove and is adjacent said front side of said mote knife;

said inclined surface being provided with a transition step;

said inclined surface merging by way of said transition step into said remainder length of said lengthwise side; and said limb being plastically deformed such that it bears against said transition step of said steel profile in order to thus provide positive and undisplaceable reception of said steel profile.

21. The mote knife arrangement as defined in claim 19, wherein:

said limb possesses a side which is remote from said front side of said mote knife; and said side of said limb being formed by an at least substantially V-shaped groove in said support having said predetermined profile.

22. The mote knife arrangement as defined in claim 21, wherein:

a further substantially V-shaped groove is provided as viewed in the carding direction downstream of a side of said limb containing said substantially U-shaped groove;

said substantially U-shaped groove for accommodating said steel profile having a base portion; and one side of said further substantially V-shaped groove being at least substantially parallel to said base portion of said substantially U-shaped groove for accommodating said steel profile.

23. The mote knife arrangement as defined in claim 21, wherein:

said support having said predetermined profile comprises a closed chamber located downstream of a region of said support containing said substantially U-shaped groove as viewed in the carding direction; and said closed chamber having a cross-section similar to a reversed "B".

24. The mote knife arrangement as defined in claim 23, wherein:

said support having said predetermined profile comprises in a central portion thereof a recess having a substantially T-shaped configuration;

said substantially T-shaped configuration having a cross-member and a limb extending substantially perpendicular to said cross-member;

said support having a lengthwise side facing the flat of the carding machine;

said cross-member of said substantially T-shaped configuration being substantially parallel to said lengthwise side which is remote from the flat of the carding machine and to said lengthwise side facing the flat of the carding machine; and said limb of said substantially T-shaped configuration opening at said lengthwise side of said support which faces the flat of the carding machine.

25. The mote knife arrangement as defined in claim 24, further including:

a further substantially V-shaped groove located downstream of said mote knife as viewed in said carding direction; and said recess which has said substantially T-shaped configuration being separated by a web from said substantially V-shaped groove located downstream of said mote knife as viewed in the carding direction.

26. The mote knife arrangement as defined in claim 24, wherein:

said recess which has said substantially T-shaped configuration is separated by a web from said closed chamber.

27. The mote knife arrangement as defined in claim 25, wherein:

said recess having said substantially T-shaped configuration contains a side which is remote from said mote knife;

a further recess is provided at said side remote from said mote knife;

said further recess having a substantially L-shaped configuration which comprises a limb extending substantially perpendicular to said lengthwise side of said support facing the flat of the carding machine;

said limb opening at said lengthwise side of said support which faces the flat of the carding machine; and said limb being separated by a web from said recess having said substantially T-shaped configuration.

28. The mote knife arrangement as defined in claim 27, wherein:

said predetermined profile of said support comprises wall parts and webs; and said wall parts and webs having at least substantially the same thickness throughout.

29. A mote knife arrangement for fitting to a flat of a carding machine in a position so as to extend substantially transversely to a predetermined carding direction and comprising a mote knife disposed at an inclination so as to extend in a direction substantially opposite to the predetermined carding direction, comprising:

a metallic profile defining the mote knife and a knife edge of said mote knife;

a support having a predetermined profile and a longitudinal direction;

said support containing members defining a groove extending in said longitudinal direction of said support for receiving said metallic profile on a side remote from said knife edge;

said support essentially consisting of light metal more readily plastically deformable than said metallic profile;

said members defining said groove of said support being permanently plastically deformed and being forged into form-locking surface engagement with said metallic profile on said side remote from said knife edge in order to thereby positively and undisplaceably retain said metallic profile at said support;

said support being structured to be mountable at the flat of the carding machine; and said longitudinal direction of said support extending substantially transversely to the predetermined carding direction.

* * * * *